United States Patent [19]

McQuade

[11] Patent Number: 5,024,473

[45] **Date of Patent: * Jun. 18, 1991**

[54] GATE LOCKING DEVICE FEATURING DEAD BOLT MEANS

[76] Inventor: Donald E. McQuade, 56 Jefferson St., Red Bank, N.J. 07701

[ * ] Notice: The portion of the term of this patent subsequent to Apr. 24, 2007 has been disclaimed.

[21] Appl. No.: 461,169

[22] Filed: Jan. 5, 1990

Related U.S. Application Data

[63] Continuation-in-part of Ser. No. 310,349, Feb. 13, 1989, Pat. No. 4,919,463.

[51] Int. Cl.[5] ..... E05C 19/10

[52] U.S. Cl. ..... 292/120; 292/106; 70/137

[58] Field of Search ..... 292/57, 120, 137, 106, 292/202, 207, 208, DIG. 13; 70/77, 137, 451

[56] References Cited

U.S. PATENT DOCUMENTS

| | | | |
|---|---|---|---|
| 3,270,536 | 9/1966 | Sprung | 292/207 |
| 3,325,203 | 6/1967 | Moler | 292/207 |
| 4,014,192 | 3/1977 | Dillon et al. | 70/77 |
| 4,111,475 | 9/1978 | McCormick et al. | 292/207 |
| 4,135,375 | 1/1979 | Voegeli | 70/77 |
| 4,196,602 | 4/1980 | Akselsen | 292/207 |
| 4,227,388 | 10/1980 | Nigrelli et al. | 70/77 |
| 4,691,541 | 9/1987 | McQuade, Sr. | 70/77 |
| 4,919,463 | 3/1990 | McQuade | 70/137 |

FOREIGN PATENT DOCUMENTS

| | | | |
|---|---|---|---|
| 969992 | 6/1975 | Canada | 292/204 |
| 262855 | 2/1913 | Fed. Rep. of Germany | 292/202 |
| 1206122 | 9/1970 | United Kingdom | 292/DIG. 13 |

*Primary Examiner*—Gary L. Smith
*Assistant Examiner*—Michael J. Milano
*Attorney, Agent, or Firm*—Weingram & Zall

[57] ABSTRACT

A gate locking device for a fence which includes a security box having a mounting plate affixed within the box. The security box is mounted to a pole of the fence. An oarlock is hingeably mounted within the security box. The oarlock is capable of movement between an unlocked position and a locked position. In the locked position the oarlock engages another pole of the fence. A dead bolt is securely affixed to the mounting plate within the security box and is movable between an extended and unextended position. The dead bolt is disposed in mechanical relation to the heel plate of the oarlock so that when the dead bolt is moved to the extended position it substantially prevents the pivotal movement of the oarlock. A barrel lock is mounted to the security box and mechanically connected and adapted to the dead bolt for moving it between the extended and unextended position. When the oarlock is moved to the locked position and the dead bolt is moved to the extended position the oarlock can not be moved back to the unlocked position and the gate is securely locked to prevent unauthorized intrusion.

17 Claims, 6 Drawing Sheets

FIG-2
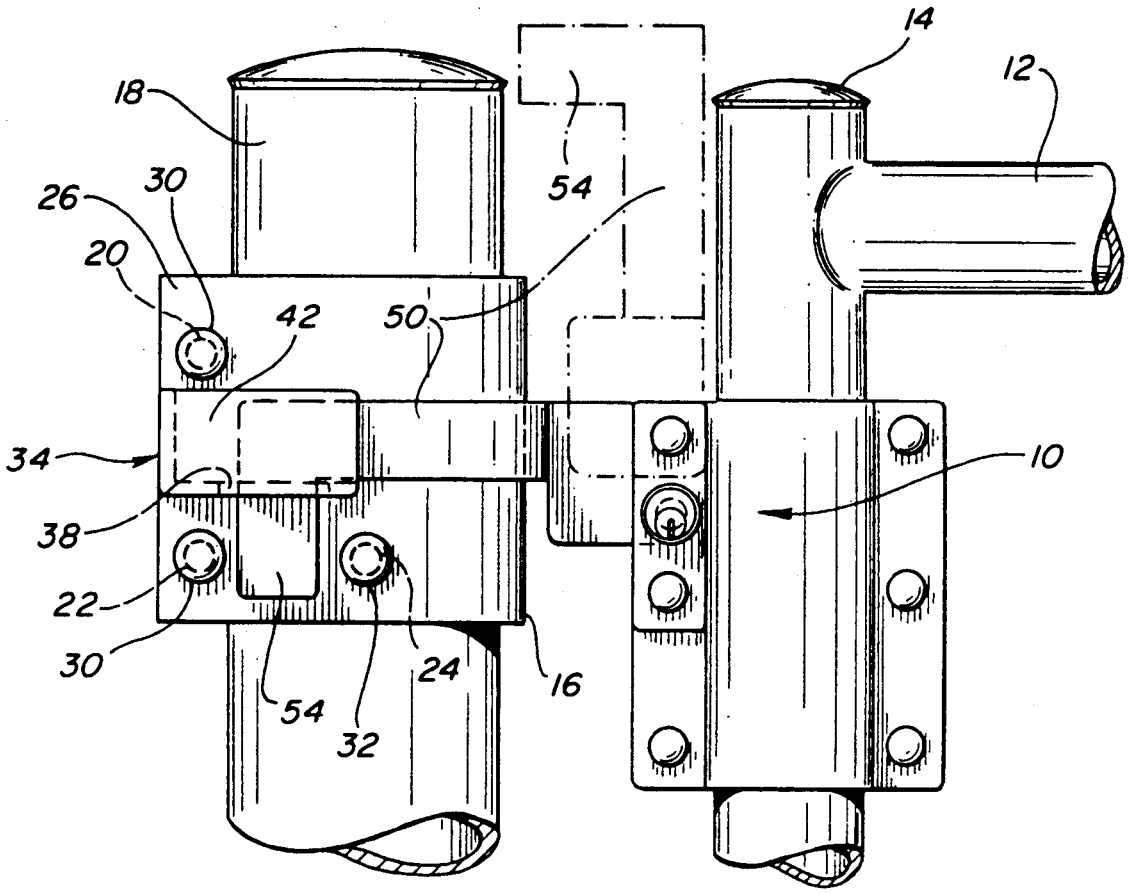
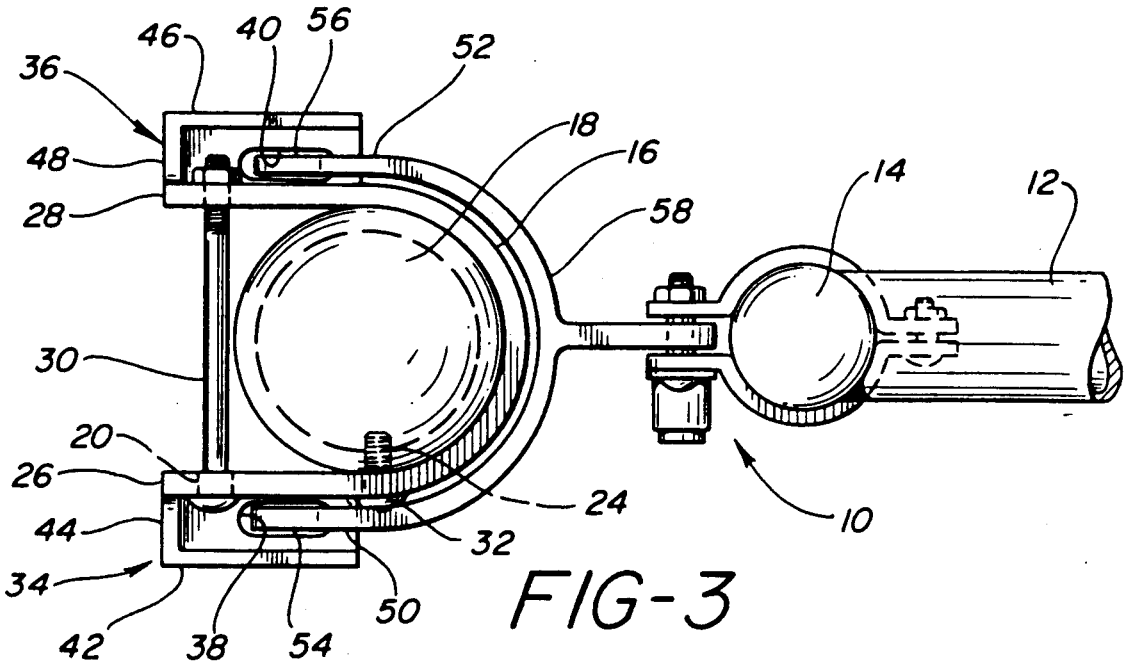
FIG-3

212
213
110
210
160
162
180
140
144
132
136
134
170
172
220
148
142
141
180
132
130
181
104
106
100

GATE LOCKING DEVICE FEATURING DEAD BOLT MEANS

This is a continuation-in-part application of Ser. No. 07/310,349, filed Feb. 13, 1989, now issued as U.S. Pat. No. 4,919,463. The entire disclosure of this application is incorporated herein by reference.

BACKGROUND OF THE INVENTION

1. Field of the Invention

This invention relates to a gate lock for a chain link fence, and more particularly, to a high security gate lock for chain link fences.

2. Prior Art

Chain link fences are well known. Typically such fences include a frame having numerous poles disposed at fixed intervals which support a mesh of thick metal wire which forms a screen. The screen is secured to the poles by pieces of wire. To provide a gate in an opening between two poles of a chain link fence, the gate being about the size of the opening is hinged to a pole on one side of the opening. An oarlock or fork latch is hingeably attached to the opposite pole of the gate frame. When the gate is in the closed position, the oarlock or fork latch is moved to the horizontal position where it receives the pole o the fence in the U-shaped portion thereof.

To lock the gate when the oarlock is in the closed position, i.e. horizontal, openings in the lock and collar are provided which line up, and a padlock is passed through the openings to lock them in their aligned position. With the lock in place, the oarlock cannot be moved from the horizontal closed position to the vertical open position. Thus the gate is locked.

The drawbacks of such a method of locking a chain link gate includes difficulty in opening and closing the lock and gate, the potential to lose or misplace the lock, and the inherent weakness of an oarlock or fork latch to tampering by an intruder. Loss of the lock occurs frequently because the padlock has to be removed from the gate to complete the locking and unlocking operation. Further, in order to unlock the gate two hands must be used, one hand to hold and steady the lock and another hand for inserting the key to open the lock.

U.S. Pat. No. 4,691,541 to the inventor herein, McQuade (hereinafter "McQuade '541") eliminates the risk of losing or misplacing the lock because the locking device is always attached to the gate frame. At no time is the lock removed from the gate to complete its operation. Operational ease is attained because the lock is stationary and the key slot is accessible. To open the lock simply insert the key and turn. When the key is turned, the lock cylinder will pop out and release the lock bar from the oarlock. To lock the gate, the oarlock is moved to its horizontal, locking position and a push button cylinder is engaged to move its lock bar into an opening in the oarlock to fix the oarlock in position.

In McQuade '541 the collar holding the lock and oarlock is modified from that typically used to retain an oarlock. The collar is in two pieces and sandwiches the pipe of the gate frame. Set screws pass through the collar causing the collar to engage the trame pipe. The lock system is comprised of several parts, and each of the parts is easily replaceable permitting quick repair. The lock provides a child proof gate lock with ease of installation. The lock is always in its proper locking position and cannot be misplaced.

The McOuade '541 gate lock works very well for its intended use as a low security gate lock, but the locking mechanism can be pulled out of the gate lock assembly by one who wishes to breach the security of the chain link fence.

OBJECTS AND SUMMARY OF THE INVENTION

An object of the invention is to provide a gate locking device for chain link fences which is a high security locking device.

Another object of the invention is to provide a gate locking device for chain link fences which has a positive locking action of a dead bolt means.

Another object of the invention is to provide a gate locking device for chain link fences which is easily locked and unlocked.

Another object of the invention is to provide a gate locking device for chain link fences which is retrofittable on existing chain link fences.

Accordingly, the gate locking device for a fence having first and second poles comprises: (a) a security box; (b) means for mounting the security box to the first pole of the fence; (c) oarlock means mounted to the security box having an oarlock, the oarlock being moveable between an unlocked position and a locked position where the oarlock receives the second pole of the fence; (d) dead bolt means affixed to the security box having a dead bolt being moveable between an extended and unextended position, when in the extended position the dead bolt substantially prevents movement of the oarlock mean; and (e) a barrel lock mounted to the security box and mechanically connected to the dead bolt and adapted for moving it, whereby when the oarlock is moved to the locked position and the dead bolt is extended the gate is securely locked to prevent unauthorized intrusion.

In a preferred embodiment the oarlock means is hingeably mounted to the box, and when the oarlock is moved to the locked position and the dead bolt is moved to the extended position, it substantially prevents the pivotal movement of the oarlock means back to the unlocked position.

In an alternative embodiment the oarlock means is slidably mounted to the security box, and when the oarlock is moved to the locked position and the dead bolt is moved to the extended position, it substantially prevents the slideable movement of the oarlock means back to the unlocked position.

BRIEF DESCRIPTION OF THE FIGURES IN THE DRAWING

A more complete understanding of the invention may be had by reference to the accompanying drawing illustrating embodiments of the invention in which like reference numeral characters refer to like parts throughout the several views and in which:

FIG. 2 is a side view of the invention shown in FIG. 1;

FIG. 3 is a top view of the invention shown in FIG. 2;

DESCRIPTION OF THE PREFERRED EMBODIMENT

Figure 1:
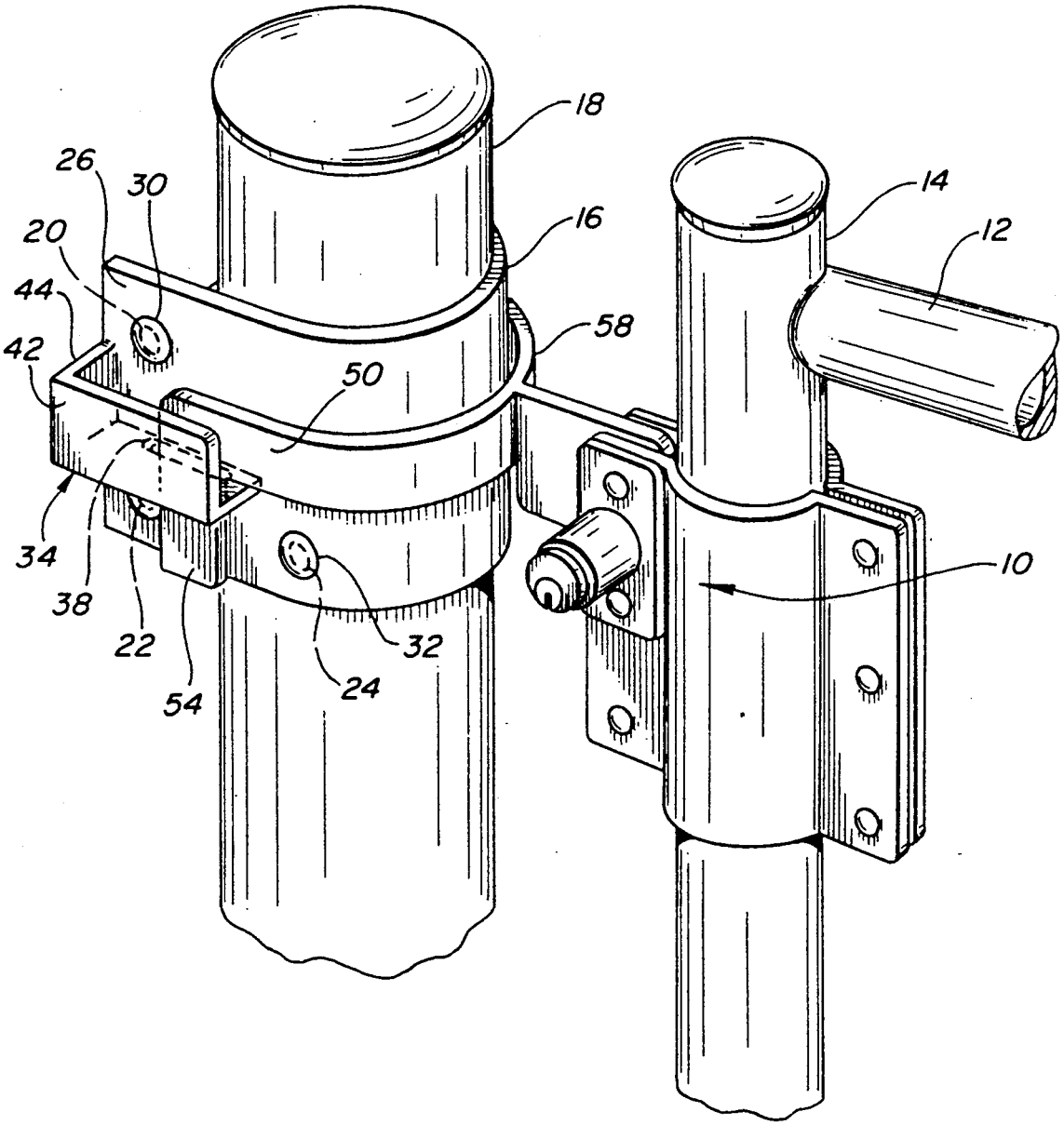
FIG. 1 is a front perspective view of the device of the invention.

As shown in FIGS. 1, 2 and 3, numeral 10 denotes generally, the gate lock disclosed and claimed in the McQuade '541 which is incorporated herein by reference. The lock 10 is mounted on gate poles or pipes 12 and 14. However, the present invention does not have the locking arrangement described in McQuade '541. The present invention is usable with any gate lock arrangement, but preferably with a gate lock that employs an oarlock or fork latch of the general type shown in McQuade '541. Oarlocks of this type are well known in the art.

As shown in FIGS. 1, 2 and 3, a "U" shaped collar 16 is mounted on and surrounds a gate pipe 18. Collar fixture 16 has bolt apertures 20 and 22 formed therein and also has a threaded screw aperture 24 formed therein. Bolt apertures 20 and 22 permit the end portions 26 and 28 of collar 16 to be bolted one to the other (a bolt 30 is shown in FIG. 3). The threaded screw aperture 24 permits additional security by tightening a screw 32, shown in FIG. 3, in aperture 24, preferably into gate pipe 18, to secure further the collar 16 to pipe 18.

Collar 16, thus secured to the gate pipe 18, has two housings 34 and 36 formed at opposite ends of the collar 16. These housing portions, 34 and 36, each have a bottom surface which contains an aperture 38 and 40 respectively, therein. Two pairs of side walls (42, 44 in housing 34, and 46, 48 in housing 36) are provided to complete the housing.

The apertures 38 and 40 and the side walls of the housings 34 and 36 cooperate with and partially enclose the sides 50 and 52 of oarlock 58 and tab portions 54 and 56 formed on said sides.

More specifically, the oarlock 58 is formed of a shape complementary to the shape of collar 16. Extended tabs 54 and 56 are found at each of the ends of the sides 50 and 52 of the oarlock 58. Only one such tab 54 is shown in FIGS. 1 and 2. The tab 54 is formed on the end of side 50 of the oarlock 58 and a corresponding tab 56 is formed on the end of side 52 of oarlock 58. The tabs 54 and 56 interfit into slots 38 and 40, respectively, in the bottom surface of the housings 34 and 36.

As will now be apparent, the security afforded at the gate lock pipe 18 by the collar fixture 16 and the tabbed oarlock 58 is greatly enhanced over that customarily employed in the prior art as represented by the oarlock 14 in McQuade '541. First, the application of force and pressure on the gate in an attempt to loosen the lock by enabling the oarlock 58 to twist out of engagement with the pipe 18 is inhibited by tabs 54 and 56 interfitting into slots 38 and 40 within the side walls of protective housings 34 and 36. Further, the tabs 54 and 56 interfit within the slots 38 and 40 and the side walls of the housings 34 and 36 and inhibit the ability of the oarlock to be twisted out of engagement with the gate pipe 14.

Secondly, the side walls 42, 44 and 46, 48 of the housings 34 and 36 also inhibit access to the point of connection of the tabs 54 and 56 on the oarlock 58 within the slots 38 and 40 of the housings 34 and 36. Any attempt to utilize a screw driver or other tool to gain leverage by forcing the screw driver or tool into the top of the housings 34 or 36 to force the screw driver underneath the oarlock 58 and thereby out of the slots 38 and 40, is impossible by virtue of the protective surfaces provided by the side walls 42, 44 and 46, 48.

Thirdly, attempts to bend an arm of the oarlock 58 to widen the opening in the oarlock 58 will be frustrated by the walls of the protective housings 34 and 36 surrounding the sides 50 and 52 of the oarlock.

Figure 4:
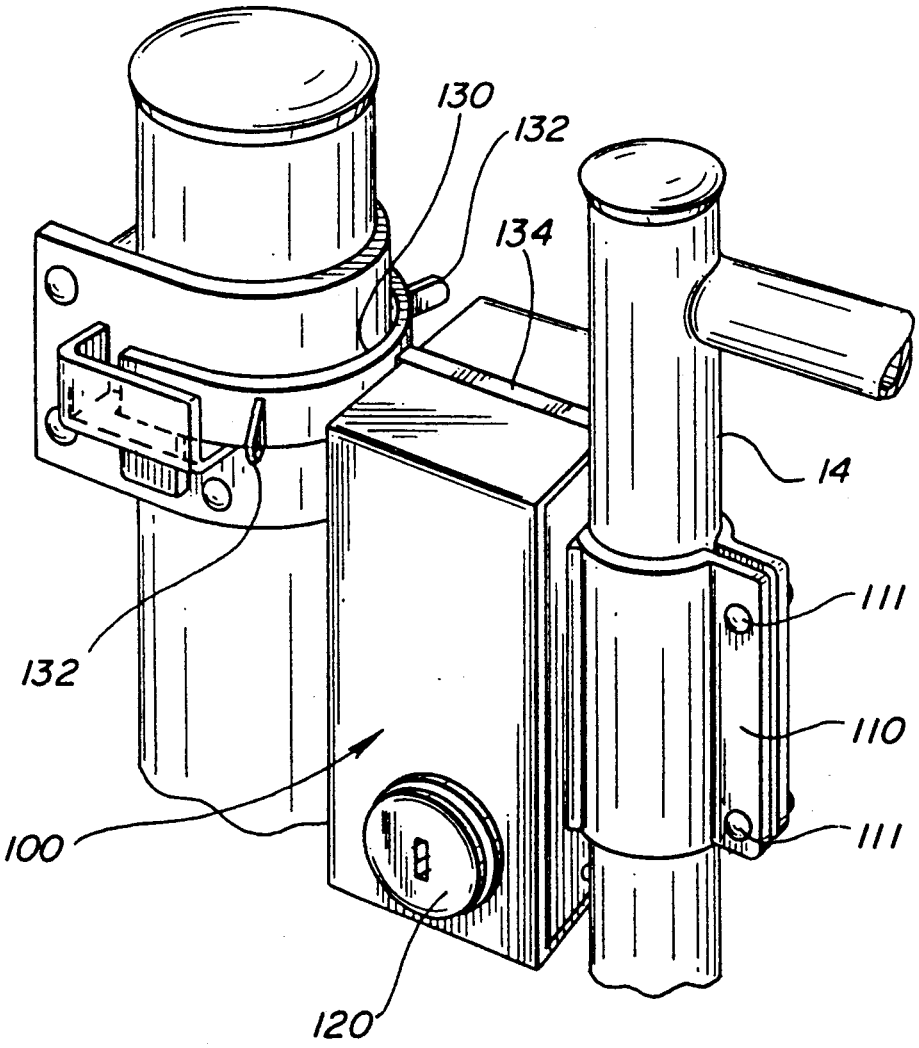
FIG. 4 is a perspective view of a second embodiment of the invention shown in FIG. 1.

Another embodiment of this invention is shown in FIG. 4, wherein a security box 100 has affixed thereon a mounting bracket 110 with carriage bolts 111 fastening it to pole 14. An oarlock 130 is shown in the horizontal locking position and is pivotally connected within the security box moveable between an unlocked and a locked position. This movement is accomplished manually by handles 132. As shown, a slot in the security box allows the oarlock 130 to extend through the security box. For the purpose of discussing the alternative embodiment oarlock 130 (FIG. 4) is substantially similar to the oarlock 58 (FIGS. 1-3) previously described.

Figure 5:
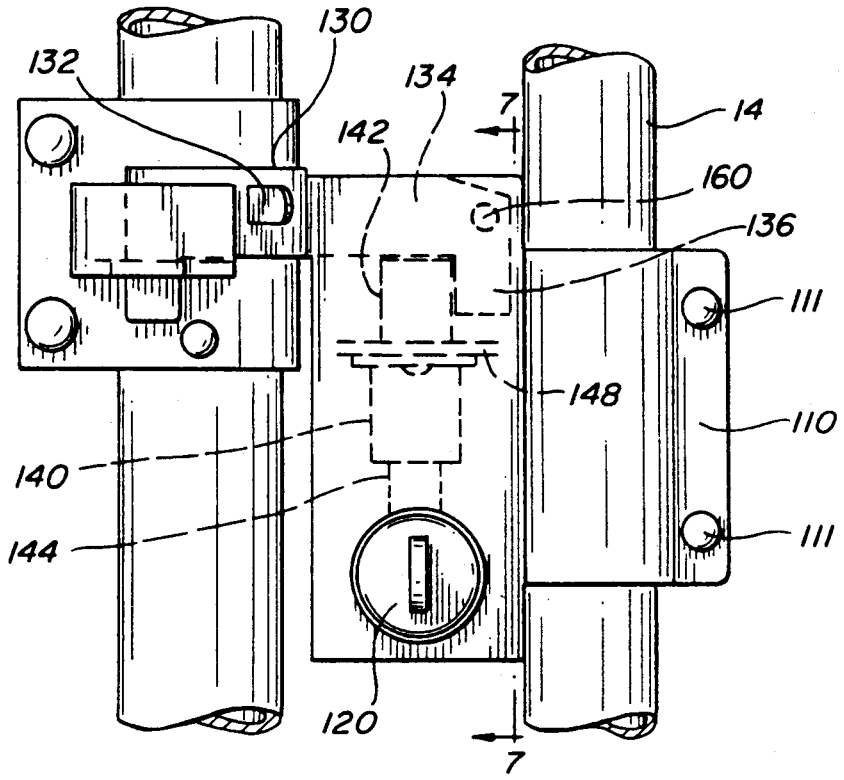
FIG. 5 is a side view of the embodiment shown in FIG. 4.
Figure 6:
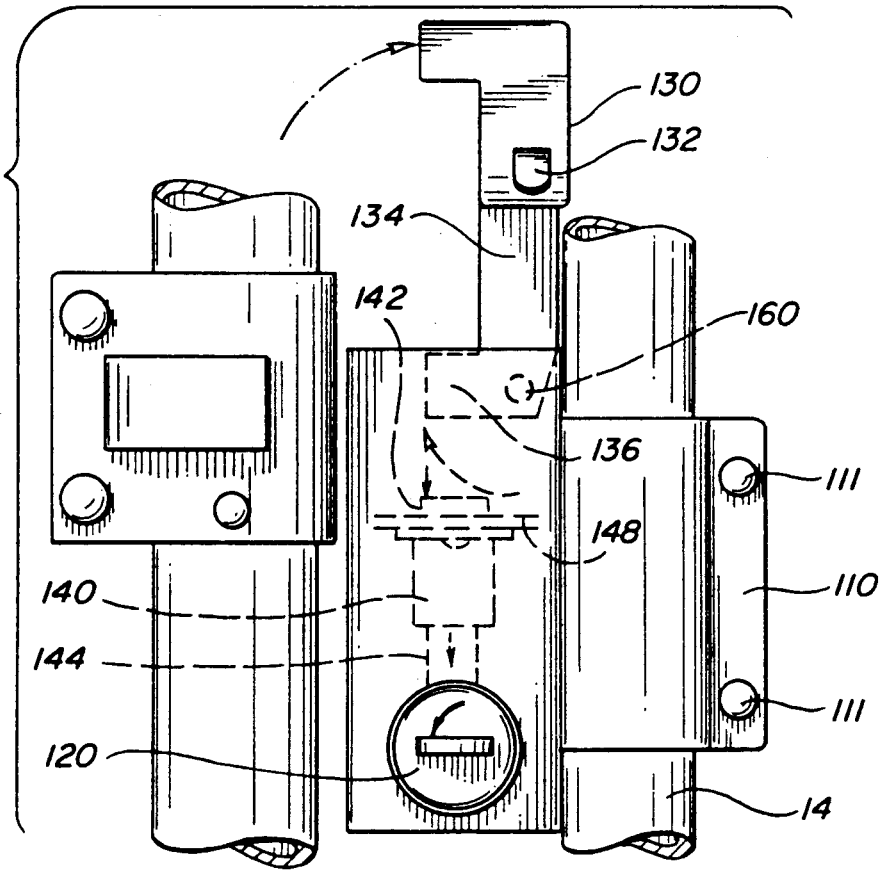
FIG. 6 is another side view of the invention shown in FIG. 4.

As shown in FIGS. 5 and 6, a lock means is shown as a barrel-type lock mechanism 120 extending from an aperture of the security box 100. As one skilled in the art would appreciate, in operation a key is inserted and turned between an unlocked and locked position. A dead bolt means 140 shown in phantom is connected to the barrel lock 120 by mechanical linkage 144 and its dead bolt 142 moves between an extended position (FIG. 5) and unextended position (FIG. 6) in response to the barrel locking mechanism 120.

The oarlock 130 is pivotally connected within the security box 100 by pin 160 and has a heel plate 136 extending therefrom which is maintained in close proximity to the dead bolt 142. In operation when the oarlock 130 is in the locked horizontal position, as shown in FIG. 5, and the dead bolt 142 is extended, the oarlock 130 is locked downwardly because any lifting upwardly of the oarlock 130 is prevented when the heel plate 136 contacts the dead bolt 142. As shown, the heel plate 136 contacts the side of the dead bolt 142. The oarlock may also be locked in the upward position in FIG. 6 if the dead bolt is extended (not shown). In an alternative embodiment, as one skilled in the art would appreciate, the dead bolt 142 may also be disposed to the right side of the pivot pin 160, and adapted so as to work equally as well (not shown).

As shown in FIG. 6 the barrel lock means 120 has been turned counterclockwise as shown by the arrow from that of FIG. 5, and the dead bolt 142 is now in its unextended position so that when the oarlock 130 is lifted to its unlocked position heel plate 136 is free to move past the dead bolt 142.

Figure 7:
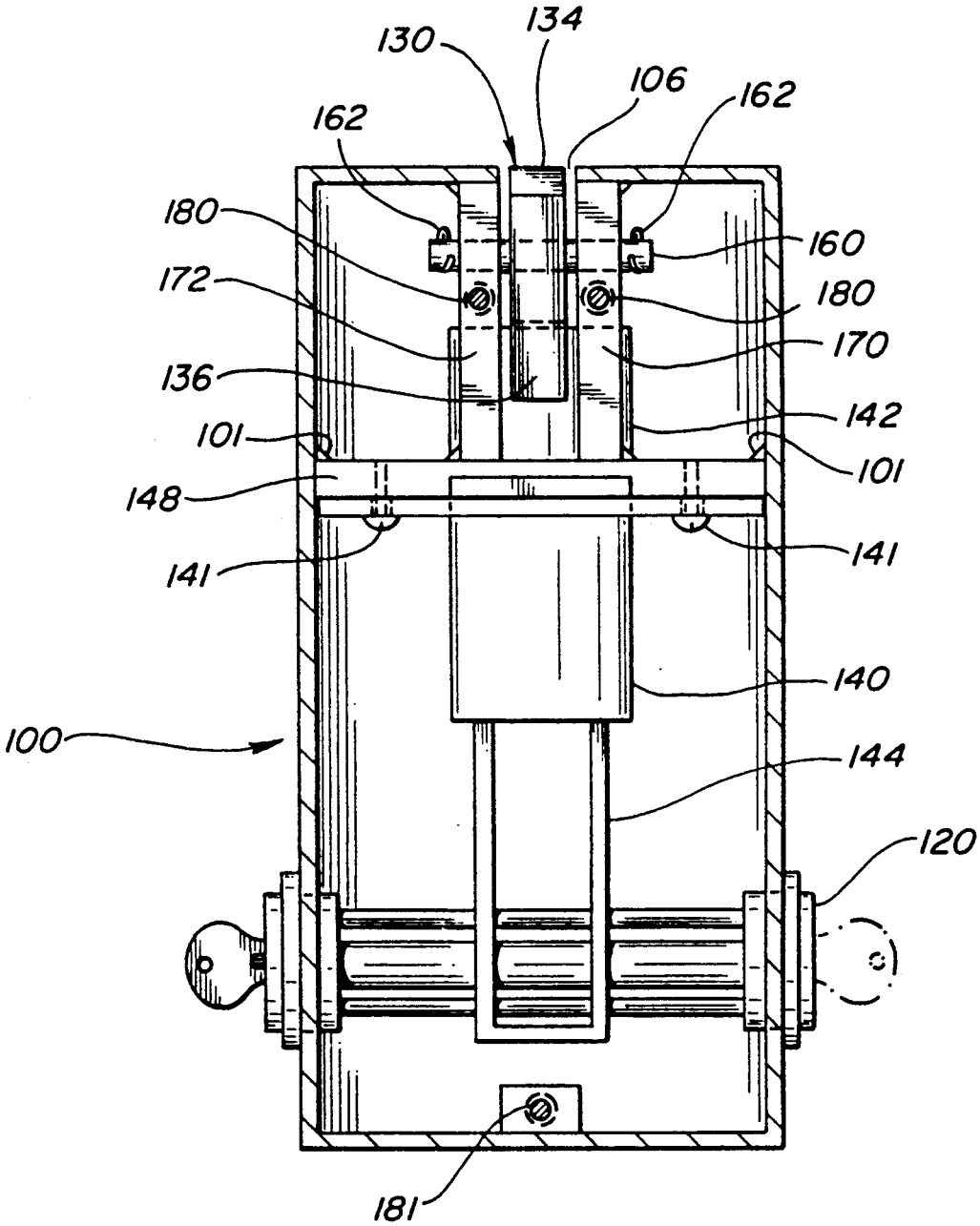
FIG. 7 is a cross-sectional view of the embodiment shown in FIG. 5 along lines 7—7 therein.

FIG. 7 shows a specific embodiment of the assembly inside the security box 100. As shown the oarlock 130 is pivotally attached to U brackets 170 and 172 by pin 160 having cotter pins 162 therein. The U brackets 170 and 172 are welded to plate 148 and plate 148 is itself welded to 100 at points 101. The dead bolt 142 is shown disposed to the left side of the pivot pin 160. The dead bolt means 140 is affixed to plate 142 by screw means 141 (see also FIG. 8 herein) and linkage 144 is shown mechanically connecting barrel lock means 120 to the dead bolt means 140. Holes 180 and 181 are shown as screw holes to receive a plate 210 as described best in FIG. 8 below.

Figure 8:
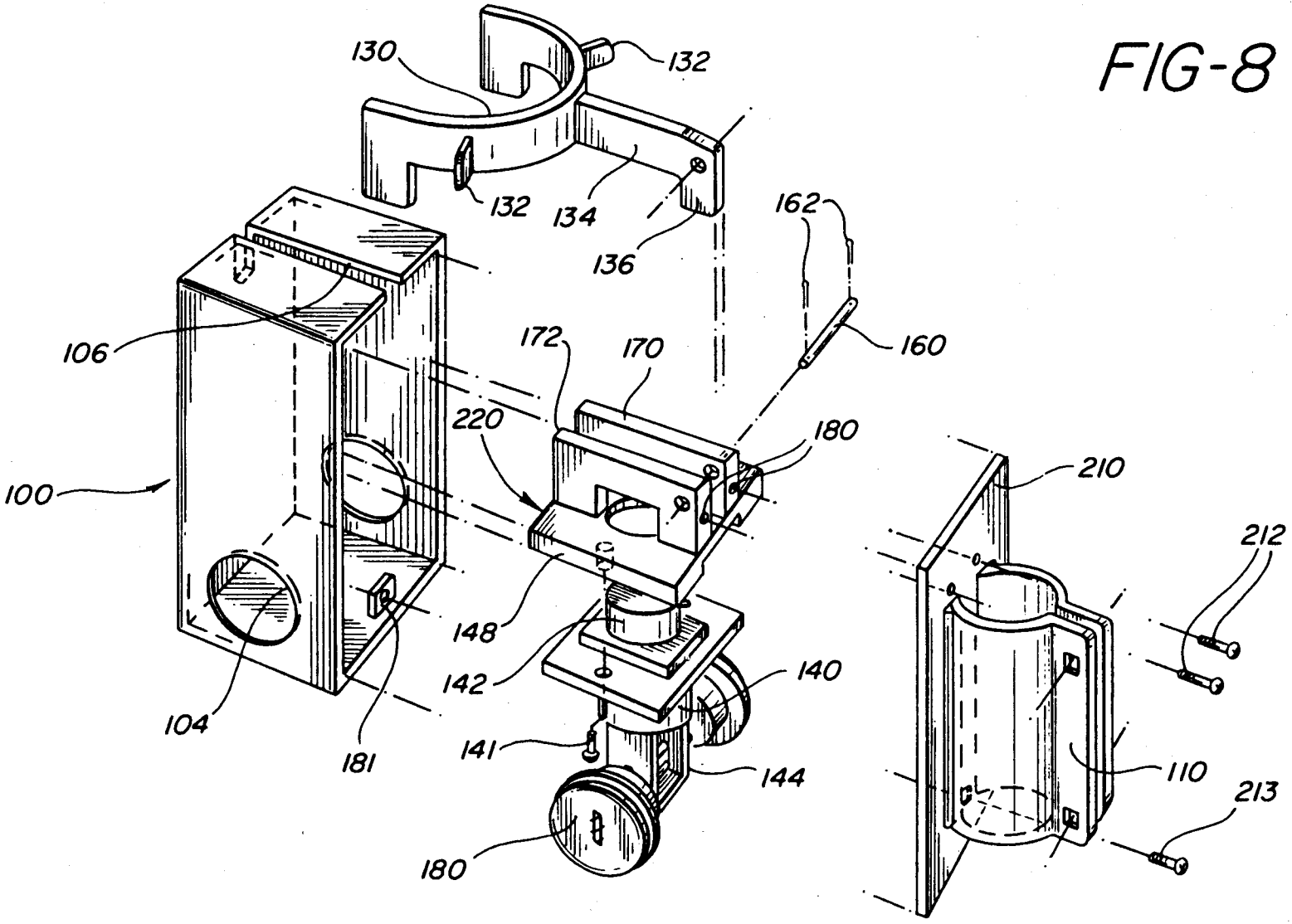
FIG. 8 is an exploded view of the embodiment shown in FIG. 4.

As shown in FIG. 8 security box 100 has aperture 104 passing therethrough and top surface slot 106 . The assembly of the barrel lock 120, dead bolt means 140 and unimolded bracket means 220 are slidably disposed within the security box and welded thereto as described herein. Cover plate 210 is then disposed on the securitY box with plate screws 212 and 213 being screwed into screw holes 180 and 181 respectively. Thereafter when the mounting means 110 is affixed to a pole (not shown), screws 212 and 213 are not reachable by one seeking to breach the integrity of the gate locking device.

In an alternative embodiment of the invention (not shown), the oarlock means may be slidably affixed to the security box, and when the dead bolt is moved to the extended position, it substantially prevents the slidable movement of the oarlock means. As one skilled in the art would appreciate, the heel plate can have one or more apertures therein for receiving the dead bolt in either the extended position, the unextended position, or both positions, to prevent unauthorized locking or unlocking of the gate.

The scope of the invention should not be limited by the particular shape of the oarlock, the particular angle of the heel plate, be it 0°, 90° or otherwise, or the particular number of apertures in the heel plate for receiving the dead bolt, since embodiments discussed herein may include no apertures, or one or more apertures.

The scope of the invention should also not be limited by the way the oarlock means is attached to the security box. For the purposes of description only, it is shown and described as being pivotally affixed to the inside of the box. But in other embodiments envisioned by the inventor, the gate locking device could work equally as well if it is pivotally attached to the outside of the box, as long as the dead bolt can be moved to a position where it substantially prevents any further movement of the oarlock means.

While the invention has been described in the preferred embodiment, it is to be understood that the words which have been used are words of description rather than limitation and that changes may be made within the purview of the appended claim without departing from the true scope and spirit of the invention in its broader aspects.

What is claimed:

1. A gate locking device for a fence comprising:

(a) security box means having a mounting plate means affixed within the box;

(b) mounting means for securely affixing the security box means to a first pole of the fence;

(c) an oarlock means hingeably mounted within the security box having an oarlock portion connected to a heel plate portion, the oarlock portion being capable of movement between an unlocked position and a locked position where the oarlock means receives a second pole of the fence;

(d) a dead bolt means fixedly disposed on the mounting plate within the security box having a dead bolt movable between an extended and unextended position and disposed in mechanical relation to the heel plate so that when the dead bolt is moved to the extended position it substantially prevents the pivotal movement of the oarlock means; and (e) barrel lock means mounted to the security box and being mechanically connected and adapted to the dead bolt means for moving it between the extended and unextended position, whereby when the oarlock portion is moved to the locked position and the dead bolt is moved to the extended position the oarlock portion can not be moved back to the unlocked position and the gate is securely locked to prevent unauthorized intrusion.

2. A gate locking device according to claim 1, wherein said device further includes an L-bracket means affixed within the security box, and the oarlock means is pivotally attached on the L-bracket means within the security box.

3. A gate locking device according to claim 1, wherein the heel plate bends at a 90-degree angle.

4. A gate locking device for locking a first pole of a fence to a second pole of the fence, comprising:

(a) a security box means defining an enclosed space having a slot therein and an aperture means and having a mounted plate means affixed within the box;

(b) mounting means for securely affixing the security box to the pole of the fence;

(c) an oarlock means extending through the slot means and hingeably mounted within the security box having its oarlock portion connected to a heel plate portion, the oarlock portion being pivotally moveable between an unlocked position and a locked position where the oarlock means receives a second pole of the fence;

(d) dead bolt means being fixedly disposed on the mounting plate within the security box having a dead bolt slidably moveable between an extended and unextended position and being mechanically arranged with the heel plate so that when the dead bolt is moved to the extended position it substantially prevents pivotal movement of the oarlock means; and (e) barrel lock means within the security box and being mechanically connected to the dead bolt means and adopted to move the dead bolt between the extended and unextended position;

whereby when the oarlock portion is moved to the locked position and the dead bolt is moved to the extended position the oarlock portion can not be moved back to the unlocked position and the gate is securely locked to prevent unauthorized intrusion.

5. A gate locking device according to claim 4, wherein said device further includes an L-bracket means affixed within the security box, and the oarlock means is pivotally attached on the L-bracket means within the security box.

6. A gate locking device according to claim 4, wherein the heel plate bends at a 90-degree angle.

7. A gate locking device for a chain link fence comprising:

(a) security box means defining an enclosed space;

(b) mounting means for securely affixing the security box means to a first pole of the fence;

(c) an oarlock means hingeably mounted to the security box having an oarlock portion having pivotal movement between an unlocked position and a locked position where the oarlock means receives a second pole of the fence;

(d) a dead bolt means securely affixed to the security box having a dead bolt slidably moveable between an extended and unextended position and disposed in mechanical relation to the heel plate so that when the oarlock portion is moved to the locked position, the dead bolt is moved to the extended position, it substantially prevents the pivotal movement of the oarlock means back to the unlocked position; and (e) barrel lock means disposed within the enclosed space of the security box and being mechanically connected to the dead bolt means and adapted to slidably move the dead bolt, (f) housing means attached to a second pole of the fence having a bottom surface and a rigid outer portion defining a substantially enclosed area for receiving arms of the oarlock and substantially enclosing the arms to inhibit and limit downward and sideward movement of the arms.

8. The gate clock as claimed in claim 7, wherein:

the arms of the oarlock includes extension means formed integrally with the arms for interfitting in an aperture in the bottom surface of the housing means for receiving the extension means to further secure the oarlock to the first means to limit and inhibit movement of the oarlock within the aperture.

9. A gate locking device for a fence having a first and a second pole comprising:

(a) a U-shaped collar having two connecting arms secured to the first pole;

(b) housing formed on one of the connecting arms, the housing having an aperture formed therein;

(c) a security box having means for mounting it to the second pole of the fence and having a mounting plate within the box;

(d) an oarlock means hingeably attached within the security box, movable between a first position where the poles are unlocked and a second position where the poles are locked, the oarlock means having a portion formed therein for interfitting into the aperture when it is in the locked position;

(e) dead bolt means fixedly disposed on the mounting plate within the security box having a dead bolt moveable between an extended and an unextended position, when in the extended position the dead bolt substantially preventing movement of the oarlock means;

(f) barrel lock means within the security box and being adapted for moving of the dead bolt between the extended and unextended positions.

10. A combination for securing an oarlock means hinge closure to a gate comprising:

(a) collar for mounting on a first portion of the gate to be closed, the collar having first and second housing portions formed thereon, the housing portions each having a respective aperture formed therein;

(b) a security box having means for mounting it to a second portion of the gate to be closed;

(c) oarlock means for hingeably mounting on the security box, the oarlock means having first and second extended portions for interfitting within the respective apertures of the housing portions, when the oarlock means is in its closed position;

(d) dead bolt means affixed to a security box having a dead bolt movable between extended and unextended positions, when in the extended position, the dead bolt substantially preventing movement of the oarlock means; and (e) barrel lock means mounted on the security box and being adapted for moving the dead bolt.

11. The combination of claim 10 wherein the oarlock means is U-shaped having first and second arms formed as either side of the "U";

the extended portions being formed adjacent the ends of each of the arms and extending angularly from the arms.

12. The combination of claim 11 wherein the collar is U-shaped, the arms surrounding the collar when the oarlock means is in its closed position.

13. A gate locking device for a fence having a first and second pole comprising:

(a) a collar means for mounting on a first pole of the fence;

(b) the collar having first and second housing portions formed thereon, the housing portions each having a respective aperture formed therein;

(c) a security box having means for mounting it to the second pole of the fence;

(d) oarlock means hingeably mounted to the security box and having first and second extended portions for interfitting within the housings and the apertures for securing the oarlock means;

(e) dead bolt means affixed to the security box having a dead bolt movable between the extended and unextended position, when in the extended position the dead bolt substantially preventing movement of the oarlock means; and (f) a barrel lock means mounted to the security box and being adapted for moving the dead bolt.

14. A gate locking device for a fence having a first and a second pole comprising:

(a) security box having means for mounting it to a first portion of the gate to be closed;

(b) a U-shaped oarlock having first and second arms formed thereon, the oarlock being hingeably mounted to the security box;

(c) housing means attached to a second portion of the gate to be locked having a bottom surface and a rigid outer portion defining a substantially enclosed area for receiving the arms of the oarlock and substantially enclosing the arms to inhibit and limit downward and sideward movement of the arm portions;

(d) a dead bolt means securely affixed to the security box having a dead bolt slidably moveable between an extended and unextended position and disposed in mechanical relation to the heel plate so that when the oarlock portion is moved to the locked position, the dead bolt is moved to the extended position, it substantially prevents the pivotal movement of the oarlock means back to the unlocked position; and (e) barrel lock means disposed within the enclosed space of the security box and being mechanically connected to the dead bolt means and adapted to slidably move the dead bolt.

15. The locking arrangement of claim 14 wherein:

the arms of the oarlock include extension means formed integrally with the arms for interfitting in an aperture in the bottom surface of the housing means for receiving the extension means to further secure the oarlock to the first means to limit and inhibit movement of the oarlock within the aperture.

16. A gate locking device for connecting between first and second pipes and a gate closure comprising:

(a) a collar secured to a first portion of the gate closure;

(b) a housing formed on the collar, the housing having an aperture formed therein;

(c) a security box having means for mounting it to the second pipe of the gate closure;

(d) a two-armed U-shaped member oarlock, hingeably secured to the security box and having a portion formed thereon for interfitting in each aperture to secure the collar and the oarlock;

(e) a dead bolt means securely affixed to the security box having a dead bolt slidably moveable between an extended and unextended position and disposed in mechanical relation to the heel plate so that the when the oarlock portion is moved to the locked position, the dead bolt is moved to the extended position, it substantially prevents the pivotal movement of the oarlock means back to the unlocked position; and (f) barrel lock means disposed within the enclosed space of the security box and being mechanically connected to the dead bolt means and adapted to slidably move the dead bolt.

17. A gate locking device for a fence comprising:

(a) security box means having a mounting plate means affixed within the box;

(b) mounting means for securely affixing the security box means to a first member of the fence;

(c) a locking member hingeably mounted within the security box having a heel plate portion and being capable of movement between an unlocked position and a locked position where the locking member interlocks with a second member of the fence;

(d) a dead bolt means fixedly disposed on the mounting plate within the security box having a dead bolt movable between an extended and unextended position and disposed in mechanical relation to the heel plate so that when the dead bolt is moved to the extended position it substantially prevents the pivotal movement of the locking member; and (e) lock means mounted to the security box and being mechanically connected and adapted to the dead bolt means for moving it between the extended and unextended position, whereby when the locking member is moved to the locked position and the dead bolt is moved to the extended position the locking member can not be moved back to the unlocked position and the gate is securely locked to prevent unauthorized intrusion.

* * * * *